US006670018B2

(12) United States Patent
Fujita et al.

(10) Patent No.: US 6,670,018 B2
(45) Date of Patent: Dec. 30, 2003

(54) NET FABRIC TO BE PROCESSED INTO NET PRODUCT

(75) Inventors: Etsunori Fujita, Hiroshima (JP); Yumi Ogura, Hiroshima (JP); Masaki Nishino, Hiroshima (JP); Eiichi Koyama, Osaka (JP); Yoshio Tsumura, Osaka (JP); Kazuhiro Ueda, Osaka (JP)

(73) Assignees: Delta Tooling Co., Ltd., Hiroshima (JP); Suminoe Textile Co., Ltd., Osaka (JP)

( * ) Notice: Subject to any disclaimer, the term of this patent is extended or adjusted under 35 U.S.C. 154(b) by 89 days.

(21) Appl. No.: 09/862,854

(22) Filed: May 22, 2001

(65) Prior Publication Data

US 2002/0034901 A1 Mar. 21, 2002

(30) Foreign Application Priority Data

May 22, 2000 (JP) ..... 2000-150269

(51) Int. Cl.[7] ..... B32B 3/02; B32B 7/02; B32B 5/26

(52) U.S. Cl. ..... 428/86; 428/156; 428/157; 428/170; 428/171; 428/172; 428/212; 428/218; 442/32; 442/49

(58) Field of Search ..... 428/156, 157, 428/161, 170, 171, 172, 212, 218, 85, 86; 442/1, 2, 32, 49

(56) References Cited

U.S. PATENT DOCUMENTS

| | | | | | |
|---|---|---|---|---|---|
| 4,409,271 | A | * | 10/1983 | Pehr | 428/71 |
| 5,079,074 | A | * | 1/1992 | Steagall et al. | 428/218 |
| 5,118,555 | A | * | 6/1992 | Horovitz | 428/178 |
| 5,616,391 | A | * | 4/1997 | Amesz et al. | 428/71 |
| 6,063,461 | A | * | 5/2000 | Hoyle et al. | 428/34.5 |

FOREIGN PATENT DOCUMENTS

| | | |
|---|---|---|
| DE | 91 05 132 | 6/1997 |
| EP | 0 774 544 | 5/1997 |
| EP | 0 808 950 | 11/1997 |
| GB | 2 009 266 | 6/1979 |

* cited by examiner

*Primary Examiner*—Ula Ruddock
(74) *Attorney, Agent, or Firm*—Steinberg & Raskin, P.C.

(57) ABSTRACT

A net fabric to be processed into a net product capable of simplifying processing during manufacturing of a net product, leading to a reduction in manufacturing cost of the net product is disclosed. The net fabric is so constructed that the side edge portions of the net fabric, which are subjected to processing such as cutting, vibrational welding or the like, have a higher compressibility in the thickness direction than the middle portions of the net fabric. This ensures that the net fabric exhibits a better workability during the manufacturing of the net product using the net fabric in order to simplify the manufacturing process, and to lead to a reduction in manufacturing cost, even though the net fabric has a three-dimensional structure.

10 Claims, 8 Drawing Sheets

NET FABRIC TO BE PROCESSED INTO NET PRODUCT

BACKGROUND OF THE INVENTION

A. Field of the Invention

This invention relates to a net fabric with a three-dimensional structure to be processed into a net product.

B. Description of the Prior Art

There has been recently known in the art a net product made of a three-dimensional net material which exhibits increased cushioning properties in spite of being formed into a reduced thickness as compared with a pad material such as urethane or the like and has a number of voids formed therein to a degree sufficient to permit it to exhibit enhanced breathability. The net material is so constructed that a front mesh layer and a rear mesh layer are connected to each other by means of a number of piles arranged therebetween, resulting in being configured into a truss structure (three-dimensional structure). Such construction permits the net product to provide an elastic structure which has resistance to setting and exhibits both a property of satisfactorily distributing a pressure of the body and a property of impact absorbing. Net products made of such a net fabric include, for example, a seat for a vehicle such as an automobile and the like.

The net material of a three-dimensional structure, as described above, includes the front mesh layer, the rear mesh layer, and the piles knittedly incorporated between the front mesh layer and the rear mesh layer and acting as an intermediate layer. When it is in the form of a starting material (a net fabric to be processed into a net product) prior to being converted into any desired net product, it has a strip-like configuration of a continuous length and a required width. The net fabric is generally provided in the form of a roll fabric wound in a roll-like shape. A processor or manufacturer of such a net product rotates the roll fabric in a direction of unwinding it, to thereby draw out it. Then, the roll fabric thus drawn out is cut into a required length and subjected to any desired processing such as vibrational welding, sewing or the like, to thereby provide a desired net product.

Unfortunately, in the conventional net fabric to be processed into a net product, the configuration of each of the front and rear mesh layers and the size thereof, as well as the knitting or weaving conditions such as the number of piles knitted or woven between both mesh layers are inevitably rendered substantially constant throughout the whole region of the net fabric. This causes the compressibility of the net fabric in the thickness direction thereof to be substantially constant over the whole region. The compressibility is determined in view of various properties such as elasticity, damping properties and the like demanded by applications of a net product made of the net fabric. Thus, when the net product is used for a seat for an automobile, the net fabric with a three-dimensional structure therefor is so manufactured that the entire net fabric may exhibit compressibility suitable for the automobile seat.

Thus, in order to make the net fabric with compressibility suitable for the properties required for the net product, in the portion of the net fabric to be processed, the compressibility is relatively low and the compressive elastic modulus is relatively high, to thereby render operation of cutting the portion troublesome because the elasticity of the portion being cut causes a resistance to the cutting. The cutting operation generally involves cutting a roll of the net fabric into net fabrics with a predetermined length and then cutting the net fabrics into desired shapes by means of a press machine, a cutter equipped with a cutting blade, a water jet type cutter using pressurized water or the like while keeping them laminated or superposed on each other. Unfortunately, during the cutting of the net fabrics laminated on top of each other, the resistance described above is apt to cause positional mismatch therebetween. Also, a reduction in compressibility causes vibrational welding operation, which is a treatment of processing ends of the net fabric (end treatment) or sawing operation to be troublesome.

SUMMARY OF THE INVENTION

The present invention has been made in view of the foregoing disadvantage of the prior art.

Accordingly, it is an object of the present invention to provide a net fabric of a three-dimensional structure which is capable of facilitating processing of the net fabric such as cutting, welding or sewing during manufacturing of a net product made from the net fabric.

It is another object of the present invention to provide a net fabric of a three-dimensional structure which is capable of simplifying processing of the net fabric such as cutting, welding or sewing, leading to a reduction in manufacturing cost of a net product made of the net fabric.

In accordance with the present invention, a net fabric of a three-dimensional structure, which can be used as a raw material for a net product, is provided. The net fabric includes a front mesh layer, a rear mesh layer, and a plurality of piles for coupling the front mesh layer and rear mesh layer to each other therethrough. In the net fabric thus generally constructed, a first portion of the net fabric to be processed in processing steps for manufacturing of the net product is relatively increased in compressibility in the thickness direction thereof as compared with that of the remaining or second portion thereof.

In a preferred embodiment of the present invention, the difference in compressibility between the portion of the net fabric to be processed and the remaining portion thereof is set to be 5% or more.

In a more preferred embodiment of the present invention, the difference in compressibility between the first portion of the net fabric to be processed and the remaining or second portion thereof is set to be within a range between 10% and 70%.

In a preferred embodiment of the present invention, the compressibility is adjusted by the density of the net structure of the net fabric.

In a preferred embodiment of the present invention, the density of the net structure is adjusted by adjusting any one element selected from the group consisting of the mesh configuration of the front mesh layer, the mesh size of the front mesh layer, the mesh configuration of the rear mesh layer, the mesh size of the rear mesh layer, the density at which the piles are arranged, the length of the piles between the front mesh layer and the rear mesh layer, the thickness of the piles, and any combination of these elements.

In a preferred embodiment of the present invention, the compressibility is adjusted by varying the material of construction for the fibers used in at least one of the front mesh layer, rear mesh layer and piles.

In a preferred embodiment of the present invention, the compressibility is adjusted by varying the type of the fibers for at least one of the front mesh layer, rear mesh layer and piles.

In a preferred embodiment of the present invention, the portion of the net fabric to be processed includes at least a side edge portion of the net fabric of a predetermined width which is defined along each of side lines thereof.

In a preferred embodiment of the present invention, the portion of the net fabric to be processed includes at least a cut portion of a predetermined width defined along each of cutting lines thereof.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

A net fabric to be processed into a net product according to the present invention will now be described with reference to the accompanying drawings.

Figure 1:
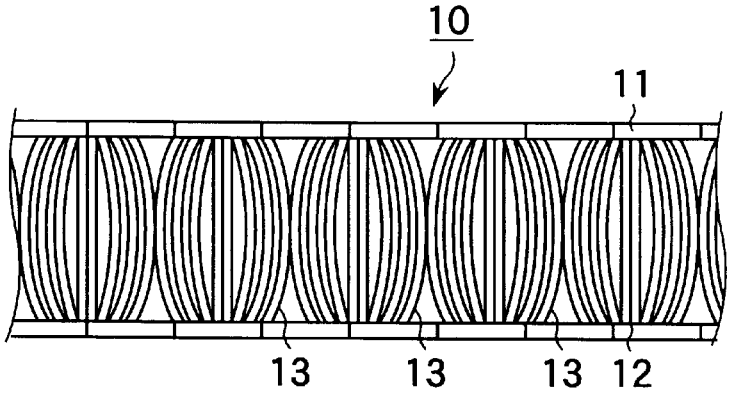
FIG. 1 is a cross sectional view showing an embodiment of a portion of a net fabric to be processed into a net product according to the present invention.
Figure 2:
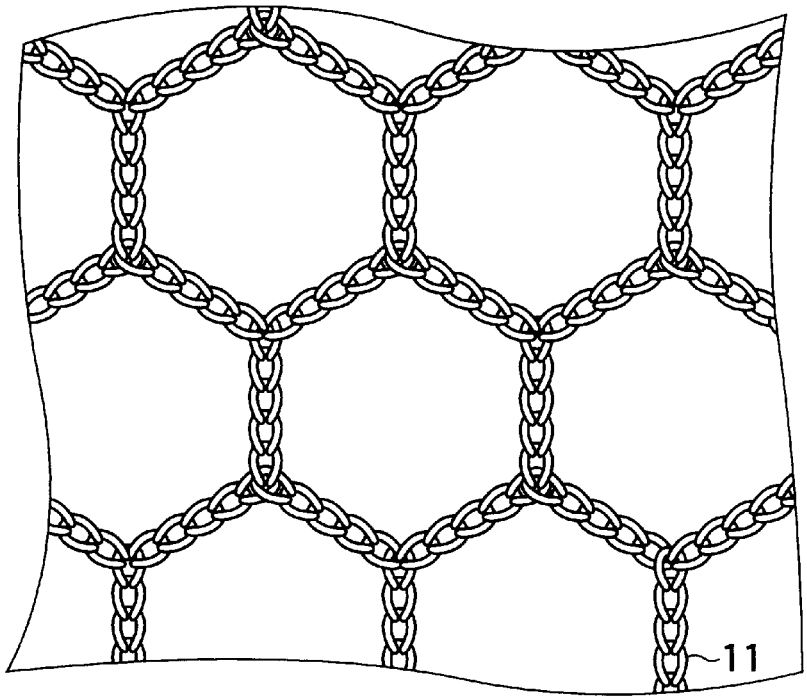
FIG. 2 is an enlarged view showing a front mesh layer incorporated in the net fabric shown in FIG. 1.
Figure 3:
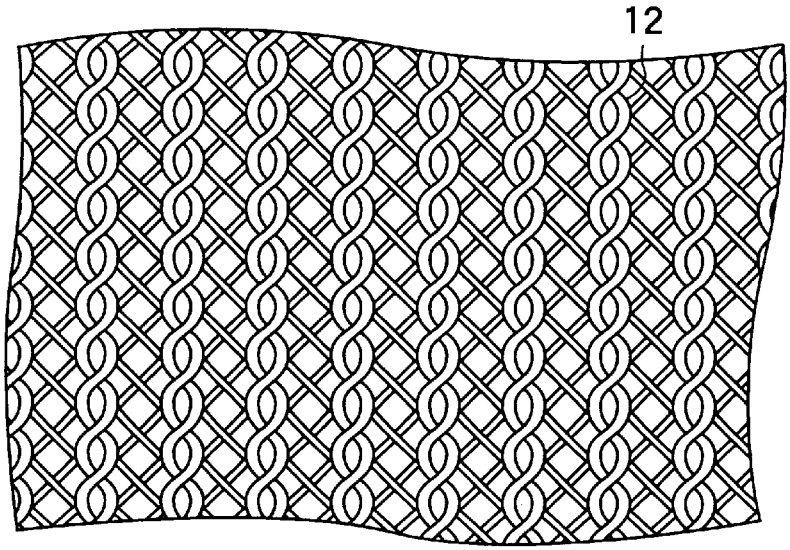
FIG. 3 is an enlarged view showing a rear mesh layer incorporated in the net fabric shown in FIG. 1.

Referring first to FIGS. 1 to 3, an embodiment of a net fabric to be processed into a net product according to the present invention is illustrated. A net fabric of the illustrated embodiment which is designated with reference numeral 10 throughout this specification, as shown in FIG. 1, generally includes a front mesh layer 11, a rear mesh layer 12 and a plurality of piles 13 arranged between both layers 11 and 12 to couple them together, resulting a steric truss structure (three-dimensional structure) of the net fabric.

The front mesh layer 11, as shown in, for example, FIG. 2, may be formed of yarns obtained by twisting monofilaments into a honeycomb-like (hexagonal) mesh structure. The rear mesh layer 12, as shown in, for example, FIG. 3, may be made by rib knitting yarns obtained by twisting monofilaments form a structure having a smaller mesh (fine mesh structure) than the honeycomb mesh of front mesh layer 11. Piles 13 may be formed of monofilaments or yarns and knittedly incorporated between front mesh layer 11 and rear mesh layer 12 so as to hold both mesh layers spaced from each other at a predetermined interval to provide net fabric 10, which has a steric knitted mesh structure, with a rigidity at a predetermined level.

The term "fiber" used herein means both a monofilament and a multifilament, as well as a spun yarn and the like.

In the illustrated embodiment, the layer including the honeycomb mesh is defined to be the front layer which is contacted with a human body when the net fabric is used in a cushion for an automobile seat. Alternatively, the layer may be used as a rear layer, wherein the layer with the smaller mesh may be used as the front layer. Any desired mesh configuration in addition to the above-described honeycomb-like mesh shape and fine mesh shape, as described hereinafter with reference to Table 1, may be used in both the front and the rear layers.

Each of the front mesh layer 11, rear mesh layer 12 and piles 13 each may be preferably made of thermoplastic resin, such as thermoplastic polyester resins represented by polyethylene terephthalate (PET), polybutylene terephthalate (PBT) and the like; polyamide resins represented by nylon 6, nylon 66 and the like; polyolefin resins represented by polyethylene, polypropylene and the like; and any combinations thereof.

The fiber for each of the front mesh layer 11, rear mesh layer 12 and piles 13 may have any desired thickness, which may be varied depending on the net product to be manufactured from the net fabric. For example, the fiber for the piles 13 has a thickness of 380d or more and preferably 600d or more, when the net fabric is manufactured into a cushioning portion of an automobile seat. Such arrangement permits the load of a person sitting on the seat to be supported by deformation of the mesh constituting each of the mesh layers 11 and 12 and compression of the piles 13, so that the net fabric may provide a flexible structure which prevents stress concentration.

Figure 4:
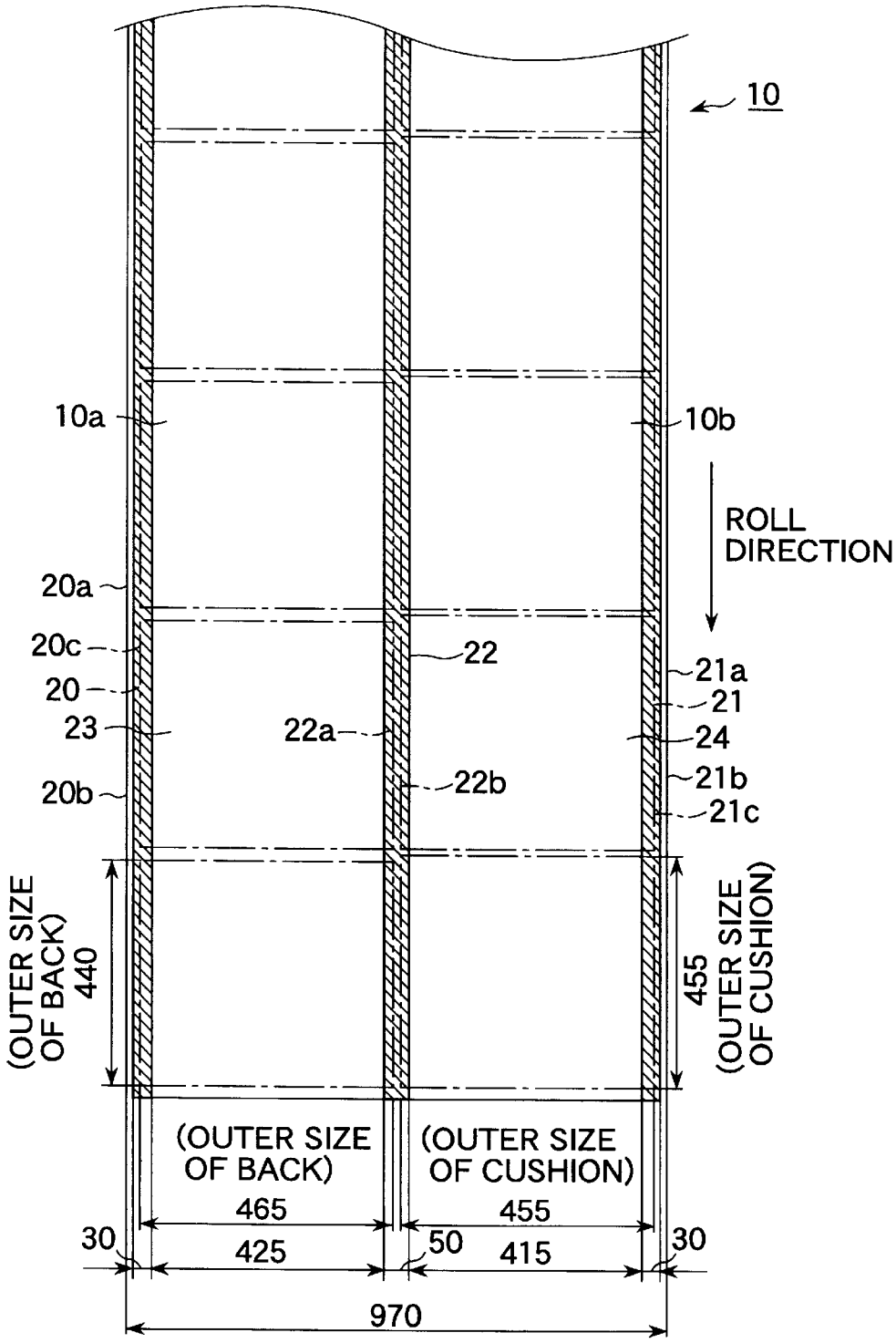
FIG. 4 is a plane view showing the net fabric to be processed into a net product of FIG. 1 which is formed into a continuous length.

FIG. 4 shows net fabric 10 for processing which is formed into a continuous length and ready to be converted into a net product. As described above, the net fabric 10 is actually provided in the form of a roll fabric wound in a roll-like manner. In the illustrated embodiment, the net fabric 10 for processing is adapted to be processed into an automobile seat. Net fabric 10 is cut at the center of the net fabric 10 along a first cut (or first) portion 22 into two pieces, so that one of the two pieces of the net fabric may be used as a net for the back portion of the automobile seat or a back seat 10*a* and the other piece of net fabric 10 may be used as a net for a cushioning portion of the automobile seat or a cushioning seat 10*b*.

In FIG. 4, each of reference numerals 20 to 22 designates a first cut or a first portion of the net fabric 10 which is relatively increased in compressibility in the thickness direction thereof and reference numerals 23 and 24 each designate a second portion thereof relatively reduced in compressibility in the thickness direction. More particularly, the net fabric 10 of a continuous length is so configured that side edge portions 20 and 21 thereof respectively defined along side lines 20*a* and 21*a* thereof and having a predetermined width and the first cut portion 22 positioned between the side lines 20*a* and 21*a* in a manner to be parallel thereto and having a predetermined width are increased in compressibility as compared with or relatively to intermediate portions 23 and 24 thereof respectively positioned between the side edge portions 20 and 21 and the first cut portion 22. The side edge portions 20 and 21 and first cut portion 22 each are subjected to various kinds of processing such as cutting, a treatment carried out on ends of the net fabric ("end treatment") and the like during manufacturing of a net product. The portions 20, 21 and 22 are constructed to exhibit a relatively increased compressibility in the thickness direction, thereby, to facilitate the processing of these portions.

The compressibility may be measured according to a procedure described in "Compressibility and Compressive Modulus" defined in JASO Standard M404-84. More specifically, the thickness of three specimens cut into dimensions of 50 mm×50 mm each are measured after being applied an initial load of 3.5 g/cm$_2$ (0.343 kPa) in the thickness direction of the specimens for 30 seconds and measured again after being applied a pressure of 200 g/cm$_2$ (19.6 kPa) again in the thickness direction for 10 minutes. Then, the thickness of the specimens is measured again after the pressure of 3.5 g/cm$_2$ (0.343 kPa) applied in the previous step being removed for 10 minutes followed by being applied another pressure of 3.5 g/cm$_2$ again for additional 30 seconds. Thereafter, both compressibility (A) and compressive elastic modulus (B) are calculated according to the following expressions (1) and (2):

$$A(\%)=\{(t_0-t_1)/t_0\}\times 100 \quad (1)$$

$$B(\%)=\{(t'_0-t_1)/(t_0-t_1)\}\times 100 \quad (2)$$

wherein $t_0$ is the thickness (mm) of the specimens after the initial application of the pressure or load of 3.5 g/cm$_2$ (0.343 kPa), wherein $t_1$ is the thickness (mm) of the specimens after the application of the load of 200 g/cm$_2$, and wherein $t'_0$ is its thickness (mm) after the second application of the load of 3.5 g/cm$_2$ (0.343 kPa).

A difference in compressibility between the side portions 20, 21 and first cut portion 22 and the intermediate portions 23, 24 is preferably 5% or more. Such arrangement that the side portions 20, 21 and first cut portion 22 is increased in compressibility by 5% or more as compared with the intermediate portions 23 and 24 permits the portions to act like a cutout, for example, during the cutting operation, so that the net fabric may be readily cut irrespective of cutting techniques. Also, it permits the end treatment to be advantageously carried out. More specifically, it significantly facilitates the vibrational welding operation which permits a thickness between the front mesh layer 11 and rear mesh layer 12 to be reduced to provide the portions with increased rigidity. More preferably, the difference in compressibility is at least 10%.

In this regard, an excessive increase in compressibility of the side edge portions 20, 21 and first cut portion 22 to a degree of causing an excessive reduction in rigidity thereof fails to ensure rigidity required to effectively carry out the vibrational welding operation. Thus, most preferably, the difference in compressibility is between 10% and 70%.

A difference in compressibility between the side edge portions 20, 21 and first cut portion 22 to be processed and the intermediate portions 23 and 24 to be processed may be obtained by any suitable means.

More particularly, one of such means is means of varying density of the net structure of the portions (density varying means), wherein the net structure of the side edge portions 20, 21 and first cut portion 22 to be processed is a reduced density as compared with that of the intermediate portions 23 and 24.

A variation in the density of the net structure by the density varying means may be accomplished by adjusting any one element selected from the group consisting of the mesh configuration of the front mesh layer 11, the mesh size of the front mesh layer 11, the mesh configuration of the rear mesh layer 12, the mesh size of the rear mesh layer 12, the density at which the piles 13 are arranged, the length of the piles 13 between the front mesh layer 11 and the rear mesh layer 12 (the thickness of the pile layer) and the thickness of the piles 13, or any combination of the elements.

More particularly, at the time of starting the step of forming the side edge portions 20, 21 and first cut portion 22 in knitting or weaving of the net fabric 10 for processing, a process such as increasing a mesh size of the front mesh layer 11 or rear mesh layer 12, changing the fine mesh shape of the net fabric to a honeycomb mesh shape or increasing the interval of knitting or weaving of the piles 13 to reduce the number of piles knitted or woven per unit length is employed to vary at least one of the above-described elements.

More specifically, adjustment in the number of piles 13 knitted permits manufacturing of the three-dimensional net fabric 10 to be carried out by presetting various factors such as the position of the net fabric where the number of piles 13 knitted is reduced, the number of piles 13 knitted and the like in a microcomputer incorporated in a knitting machine. Supposing that, for example, the net fabric 10 for processing of 970 mm in width is made by knitting, the number of piles 13 knitted is reduced within a region of the net fabric 10 inwardly extending by 30 mm from one side line 20*a* except one grip margin 20*b* of several millimeters for a heat-set fixture, to thereby provide one side edge portion 20. Then, the number of piles 13 knitted is increased to form the intermediate portion 23 which is used for constituting the back net 10*a*. Thereafter, the number of piles 13 knitted is reduced within the region of 50 mm from the center of the net fabric, to thereby form the first cut portion 22. Subsequently, the number of piles 13 knitted is increased to form the intermediate portion 24 constituting the cushioning net 10*b* and then the number of piles 13 knitted is decreased in the region inwardly extending by 30 mm from the other side line 21*a* except the other grip margin 21*b* for the heat-set fixture, to thereby form the other side edge portion 21.

The term "heat set" or "heat setting" referred to herein means that heat is applied to the net fabric which has already been knitted while the net fabric being stretched by gripping each of the grip margins 20*b* and 21*b* by means of a fixture or gripper (not shown), to correct the shrinkage of the net fabric due to knitting. After the heat setting, the net fabric 10 is generally wound in the form of a roll fabric for shipping. In this regard, the illustrated embodiment is so constructed that the net structure is reduced in density as seen in the side edge portions 20, 21 and first cut portion 22, resulting in the net fabric having a portion relatively increased in compressibility. This permits the net fabric 10 of the illustrated embodiment to have less warpage due to shrinkage than the conventional net fabric having uniform or equal compressibility or density, so that the heat setting operation may be facilitated in a short period of time.

Another means for partially varying compressibility of the net fabric 10 in a thickness direction thereof may be also used, wherein a material of fibers for at least one of the front mesh layer 11, rear mesh layer 12 and piles 13 is varied. For example, the piles 13 may be so constructed that the intermediate portions 23 and 24 are formed of a material exhibiting increased rigidity such as polyester, polypropylene or the like and the side edge portions 20, 21 and first cut portion 22 are formed of a material reduced in rigidity as compared with the portions 23 and 24, such as nylon, PBT or the like.

Alternatively, the compressibility may be adjusted by varying the type of fibers for at least one of the front mesh layer 11, rear mesh layer 12 and piles 13. The term "type of fibers" referred to herein means a monofilament, a multifilament, a spun yarn and the like. When fibers have the same material and thickness (outer diameter), a monofilament has a higher rigidity than a multifilament. For example, when the piles 13 are constructed in such a manner that the intermediate portions 23 and 24 are made of a monofilament and the side edge portions 20, 21 and first cut portion 22 are made of a multifilament having the same material and thickness as the monofilament, the portions 20 to 22 may have a relatively higher compressibility than the portions 23 and 24.

Also, a variation in compressibility of the net fabric 10 may be carried out by suitably combining two or more of the above-described means together. For example, the side edge portions 20, 21 and first cut portion 22 may be made of a multifilament, wherein the multifilament may be thinner than the monofilament used in the piles 13 incorporated in the intermediate portions 23 and 24. Alternatively, in this instance, the multifilament may be made of a material having a lower rigidity. Optionally, means of reducing density of the net structure may be employed for this purpose. Furthermore, any combination of these approaches may be employed.

The following Table 1 illustrates characteristics of the net fabrics 10, each of which permits the intermediate portions 23 and 24 to exhibit properties or characteristics suitable for use for a back portion of an automobile seat or a cushioning portion thereof and permits the side edge portions 20, 21 and first cut portion 22 to exhibit characteristics for easy processing. In each of the net fabrics 10 shown in Table 1, compressibility is adjusted by adjusting the number of piles 13 arranged per unit length.

the fiber. For example, "220d" equals the thickness of a fiber weighing 1 g for each 9,000/220=40.9 m. "f" means the number of monofilaments. For example, "70f" means that there are 70 monofilaments in a single yarn. The unit "kg/5 cm" for tensile strength indicates strength of the net fabric of 5 cm in width. The term "parallel" in the pile structure means that the piles 13 for coupling the front mesh layer 11 and rear mesh layer 12 together do not intersect each other as viewed sideward. "Cross" indicates that they do intersect each other when being viewed sideway.

Arrangement of the piles 13 (pile structure) may be carried out in each of the configurations as shown in FIGS. 10(*a*) to 10(*e*), wherein the piles 13 through which the front mesh layer 11 and rear mesh layer 12 are coupled together are viewed sideway. FIGS. 10(*a*) and 10(*b*) each shows a straight arrangement manner in which the piles 13 each are arranged between each of yarns constituting the front mesh layer 11 and each of yarns constituting the rear mesh layer 12 opposite thereto, wherein FIG. 10(*a*) shows the piles 13 straightly knitted in an 8-shaped configuration and FIG. 10(*b*) shows the piles 13 straightly knitted in a simple configuration. FIGS. 10(*c*) to 10(*e*) each show the piles 13 each arranged so as to extend between each of yarns of the front mesh layer 11 and each of yarns of the rear mesh layer 12 adjacent to each of yarns of the rear mesh layer 12 opposite to each of the yarns of the front mesh layer 11 while intersecting each adjacent pile 13. More particularly, in FIG. 10(*c*), the piles 13 are arranged to show the shape of the numeral "8." In FIG. 10(*d*), the piles 13 are knitted in a simple cross configuration. In FIG. 10(*e*), the piles 13 are arranged in a double cross configuration.

Now, manufacturing an automobile seat using the net fabric of the illustrated embodiment constructed as described above will be described.

First, as shown in FIG. 4, the net fabric 10 is drawn out of the roll fabric and cut into a length which is easy to handle

TABLE 1

| Number | | 1 | 2 | 3 | 4 | 5 | 6 |
|---|---|---|---|---|---|---|---|
| Material | Front | Nylon | Polyester | ← | ← | ← | ← |
| | Rear | Nylon | Polyester | ← | ← | ← | ← |
| | Piles | Nylon | Polyester | ← | PBT | Polyester | ← |
| Weight (g/m$^2$) | | 888 | 968 | 1132 | 1168 | 1160 | 1152 |
| Density of | Longitudinal (fibers/inch) | 7 | 8 | 9 | 9 | 10 | 8 |
| Portions 23, 24 | Lateral (fibers/inch) | 13 | 15 | 14 | 13 | 131 | 14 |
| Density of | Longitudinal (fibers/inch) | 6 | 6 | 7 | 8 | 8 | 6 |
| Portions 20 to 22 | Lateral (Fibers/inch) | 13 | 15 | 14 | 13 | 13 | 14 |
| Thickness of | Front | 220d/1f | 1300d/96f | 1300d/96f | 1300d/96f | 1300d/96f | 1300d/96f |
| Fibers | Rear | 220d/1f | 500d/70f | 500d/70f | 1300d/96f | 500d/70f | 1300d/96f |
| | Piles | 880d/1f | 600d/1f | 600d/1f | 800d/1f | 800d/1f | 800d/1f |
| Tensile Strength | Longitudinal | 38.0 | 147.5 | 173.4 | 117.2 | 205.9 | 162.8 |
| (Kg/5 cm) | Lateral | 24.8 | 75.5 | 180.4 | 117.2 | 49.1 | 79.5 |
| Elongation (%) | Longitudinal | 111.1 | 67.1 | 72.7 | 63.2 | 61.8 | 65.8 |
| | Lateral | 189.3 | 111.2 | 109.9 | 82.5 | 133.8 | 117.2 |
| Tear Strength (kg) | Longitudinal | 33.8 | 78.3 | 78.3 | 117.3 | 119.4 | 106.8 |
| | Lateral | 26.2 | 76.2 | 76.2 | 73.2 | 48.9 | 73.3 |
| Distortion Ratio | Longitudinal | — | 2.3 | 2.3 | 2.1 | 0.2 | 0.7 |
| by Repeating Loading | Lateral | — | 2.5 | 2.5 | 1.4 | 23.2 | 9.2 |
| Portions 23 & 24 | Thickness (mm) | 12.5 | 13.1 | 13 | 12.1 | 11.7 | 12.7 |
| | Compressibility (%) | 65.7 | 64.2 | 54.7 | 38.9 | 62.1 | 12.7 |
| | Elastic Modulus (%) | 95.2 | 93.9 | 95.0 | 95.1 | 94.1 | 88.8 |
| Portions 20 to 22 | Thickness (mm) | 12.5 | 12.8 | 13.0 | 12.0 | 11.5 | 12.5 |
| | Compressibility (%) | 85.2 | 80.9 | 80.7 | 79.3 | 78.6 | 80.3 |
| | Elastic Modulus (%) | 45.0 | 39 | 42.9 | 46.9 | 48.9 | 44.1 |
| Structure of | Front | Mesh | Honeycomb | Mesh | Honeycomb | Honeycomb | Honeycomb |
| Mesh Layer | Rear | Mesh | Fine mesh | Fine mesh | Mesh | Fine mesh | Mesh |
| Structure of Piles | | Parallel | Cross | Cross | Cross | Cross | Cross |

Figure 5:
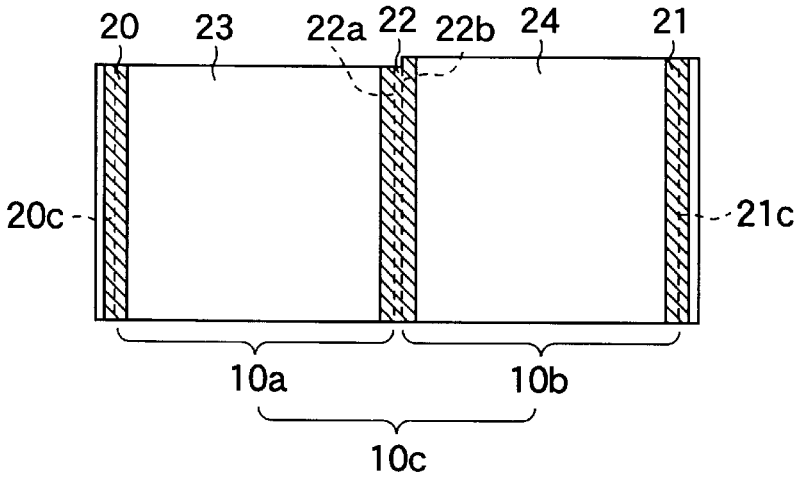
FIG. 5 is a plan view showing a set of seat nets cut out of the net fabric shown in FIG. 1.

In Table 1, "d" is an abbreviation of "denier". "1d" equals to the thickness of a fiber weighing 1 g for each 9,000 m of in the width direction thereof. Then, as shown in FIG. 5, each set of seat nets 10*c* in which the back net 10*a* and cushioning net 10*b* are integrated with each other are cut out from the cut net fabric 10.

Figure 6:
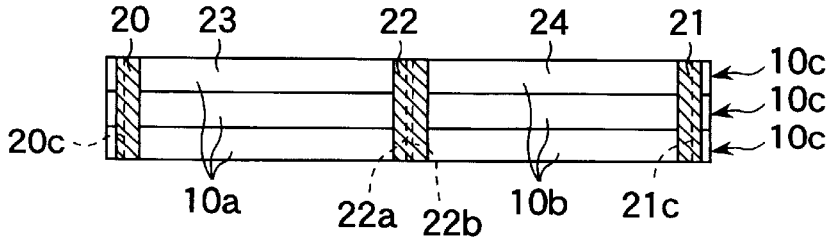
FIG. 6 is a schematic view showing a step of cutting a plurality of seat nets while keeping them superposed on each other.

Then, as shown in FIG. 6, the each set of the seat nets 10*c* thus cut are laminated on each other on a processing pedestal of any suitable cutting machine such as, for example, a water jet type cutter while being aligned with each other. Then, the cutter is activated to cut the seat nets along predetermined cutting lines 22*a* and 22*b* by means of high-pressure water. In the illustrated embodiment, the first cut portion 22 is increased in compressibility as compared with the intermediate portions 23 and 24, to thereby be readily compressed. Also, the net fabric 10 is configured into a three-dimensional structure. Such construction substantially eliminates the problems of elastic force which deteriorates cut properties of the net fabric. More particularly, the conventional net fabric is so configured that the intermediate portions 23 and 24 has the same compressibility as the first cut portion 22 and the compressibility is set at such a level that the compressibility is suitable for portions 23 and 24 to be used as a cushioning portion and a back portion. Thus, the conventional net fabric has compressibility set at a relatively low level and a compressive modulus set at a relatively high level. Thus, cutting of a plurality of the conventional net fabrics laminated or superposed on each other causes an elastic force thereof to act as a resistance, leading to the curvature of the cutting line. Also, cutting of the conventional net fabrics laminated on each other by means of a water jet type cutter fails to cut the upper net fabrics. On the contrary, in the illustrated embodiment, the first cut portion 22 is increased in compressibility, to thereby exhibit a function similar to that obtained when a cutout is preformed on the net fabric, so that a plurality of net fabrics laminated on each other may be accurately cut at a predetermined position without substantially causing positional mismatch between the net fabrics.

As being noted from Table 1 described above, the compressibility and compressive modulus are not necessarily inversely proportional to each other. Thus, both compressibility and compressive modulus may be increased. Alternatively, both may be reduced. In any event, a relative increase in compressibility facilitates the cutting operation and/or vibrational welding operation even when the compressive modulus is not reduced to the same degree.

Thus, the back and cushioning nets 10*a* and 10*b* are separated from each other at the first cut portion 22 to form the back portion and cushioning portion of the automobile seat. Then, a plurality of back nets 10*a* and cushioning net 10*b* are superposed on each other, respectively, and cut along cutting lines 20*c* and 21*c* indicated at broken lines in the side edge portions 20 and 21 (FIGS. 4 to 6). In this instance as well, the side edge portions 20 and 21 have compressibility set as described above, so that the cutting may be carried out readily and accurately as in the cutting along the first cut portion 22.

Figure 7:
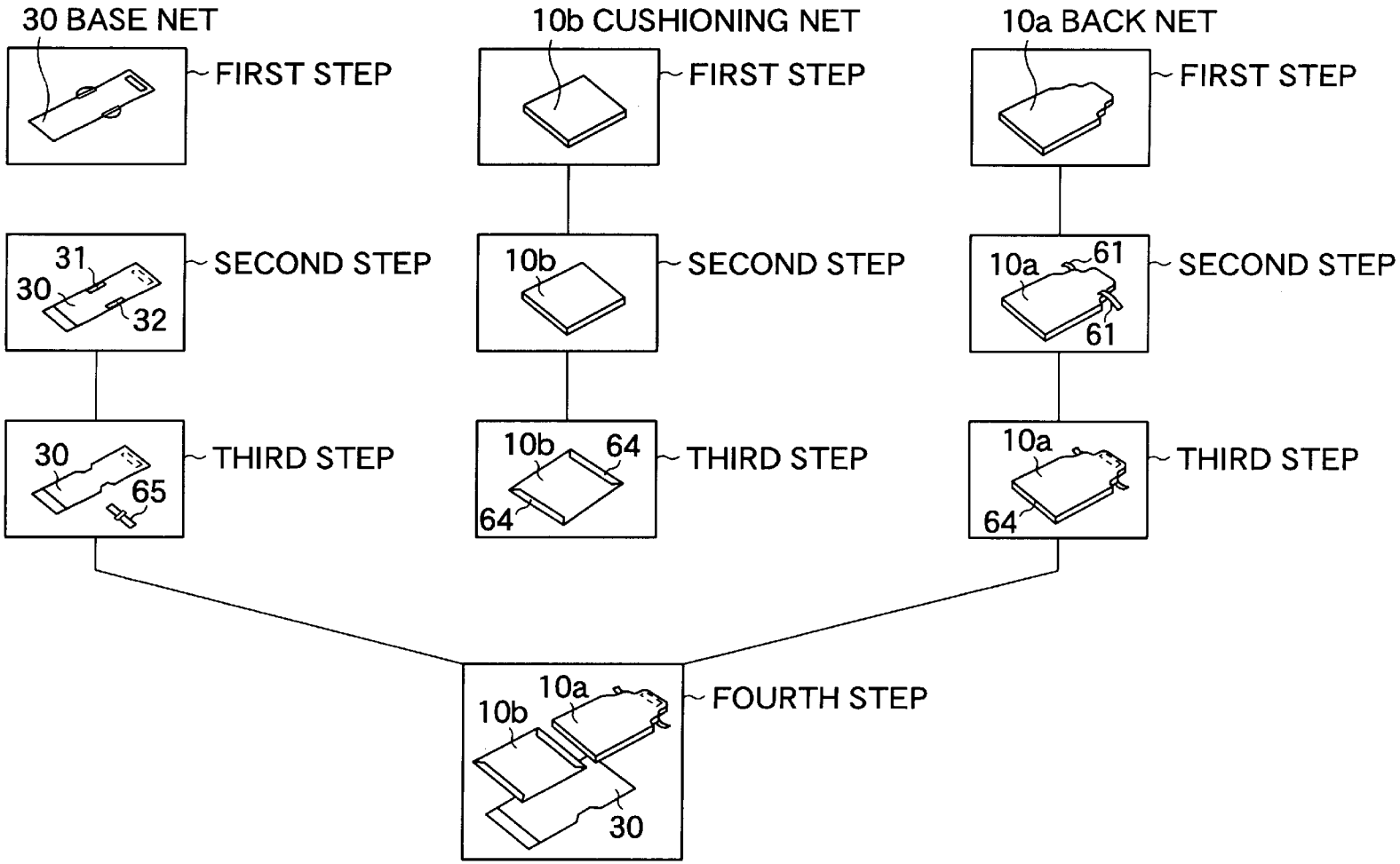
FIG. 7 is a schematic view showing a step of manufacturing a cut back net and a cut cushioning net into an automobile seat which is a net product.

Each of the back nets 10*a* and cushioning nets 10*b* which have been thus cut out is then subjected to a fine cutting operation, to thereby be cut into a desired shape as indicated in a first step shown in FIG. 7.

During the second step, washers 61 for connecting the back net to a seat frame are mounted on both sides of the back net 10*a* by sewing. Then, a trim 63 for decoration is attached to the end of the back net 10*a* by sewing. The cushioning portion 10*b* has an unnecessary end portion removed by cutting in the second step. Then trims 64 for decoration are attached to the ends of the cushioning portion 10*b* by sewing during the third step.

When the trims 63 and 64 for decoration are attached on the side edge portions 20 and 21 or the like having compressibility set at a relatively high level, the illustrated embodiment facilitates the sewing operation while preventing breaking of a sewing needle or the like during the operation because the net structure of the net fabric has a lower density.

In addition to the back net 10*a* and cushioning net 10*b*, a base net 30 is prepared by cutting the net fabric 10 in substantially the same manner as the nets 10*a* and 10*b* as indicated in a first step. The base net is likewise constructed so that portions thereof to be processed have a higher compressibility in the thickness direction than the remaining portions thereof. In a second step, side edge portions of the base net 30, which are made to have a higher compressibility are inwardly folded at parts 31 and 32 thereof, which are then subjected to vibrational welding. Then, in a third step, a reinforcing belt 65 is attached to a suitable portion of the base net 30 by vibrational welding.

Figure 8:
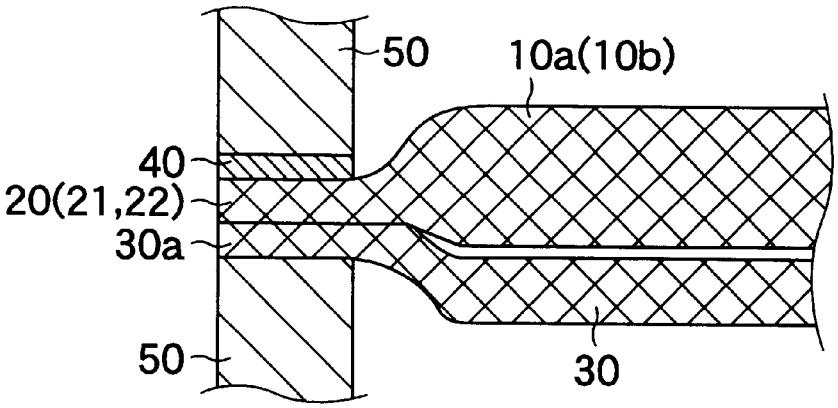
FIG. 8 is a schematic view showing a vibrational welding step.

The back net 10*a*, cushioning net 10*b* and base net 30 which have been thus processed are assembled together in a common fourth step. The assembling is carried out by fixing the side edge portions 20, 21 or first cut portion 22 of the back net 10*a* or cushioning net 10*b* to a portion 30*a* of the base net 30, which has a higher compressibility by vibrational welding to integrate them together, as shown in FIG. 8. At this time, a plate 40 made of synthetic resin is arranged between fixtures 50 for vibrational welding and is concurrently subjected to vibrational welding.

Vibrational welding exhibits large bonding strength. Thus, portions of the front mesh layer 11, rear mesh layer 12 and piles 13 which have been subjected to vibrational welding are joined together, so that parts of the front mesh layer 11 and rear mesh layer 12 constituting the side edge portions 20, 21 and first cut portion 22 are fixed together and hardened while being kept in proximity to each other. This permits the portions of the net fabric subjected to the vibrational welding operation or end treatment to be held on the seat frame by screwing, hitching or the like. In this regard, in the illustrated embodiment, the side edge portions 20, 21 and first cut portion 22 which are to be subjected to vibrational welding have a higher compressibility in the thickness direction thereof than the intermediate portions 23 and 24, so that vibrational welding of the base net 30 may be directly carried out after cutting thereof.

On the contrary, in the conventional net fabric, the portions to be subjected to vibrational welding are identical in compressibility with the other portions. Such construction of the prior art makes the direct application of vibrational welding to the base net 30 after the cutting operation as in the illustrated embodiment to form a bonding therebetween difficult. In order to eliminate such a disadvantage, the prior art requires an extra step, during which the back net 10*a* and cushioning net 10*b* are vibrationally welded separately so that the welded portions of the back net 10*a* and the cushioning net 10*b* are semi-crushed, between the first step and the second step shown in FIG. 7 after the cutting operation. The prior art also requires an extra step, during which the base net 30 is vibrationally welded so that the welded portion of base net 30 is semi-crushed after the third step when the reinforcing belt 65 is attached. The illustrated embodiment eliminates the need of such extra steps, to thereby significantly simplify manufacturing of the net product, leading to a reduction in manufacturing cost. Also, the illustrated embodiment minimizes a reduction in mechanical characteristics of the fibers because vibrational welding generally reduces mechanical characteristics of the fibers.

Further, in the illustrated embodiment, the portions of the net fabric which are to be subjected to vibrational welding have a relatively high compressibility, to thereby ensure satisfactory vibrational welding, to effectively prevent the piles 13 from partially projecting from an end surface of the net product due to a failure in vibrational welding.

In the illustrated embodiment, the end treatment by vibrational welding is not limited to the fourth step shown in FIG. 7. Thus, in order to enhance rigidity of the end portions or side edge portions 20, 21 or the first cut portion 22 to ensure the fixing of the net product onto the seat frame or the like by screwing, hitching or the like, some predetermined sites of end portions of the back net 10*a*, cushioning net 10*b* or the like may be individually subjected to vibrational welding. For example, portions of the front mesh layer 11, rear mesh layer 12 and piles 13 corresponding to the end portions may be welded together to provide a predetermined hardness. Also, the above-described plate made of synthetic resin (FIG. 8) may be additionally fixed thereto by vibrational welding. The illustrated embodiment even facilitates the end treatment, because the portions to be processed have a higher compressibility.

Figure 9:
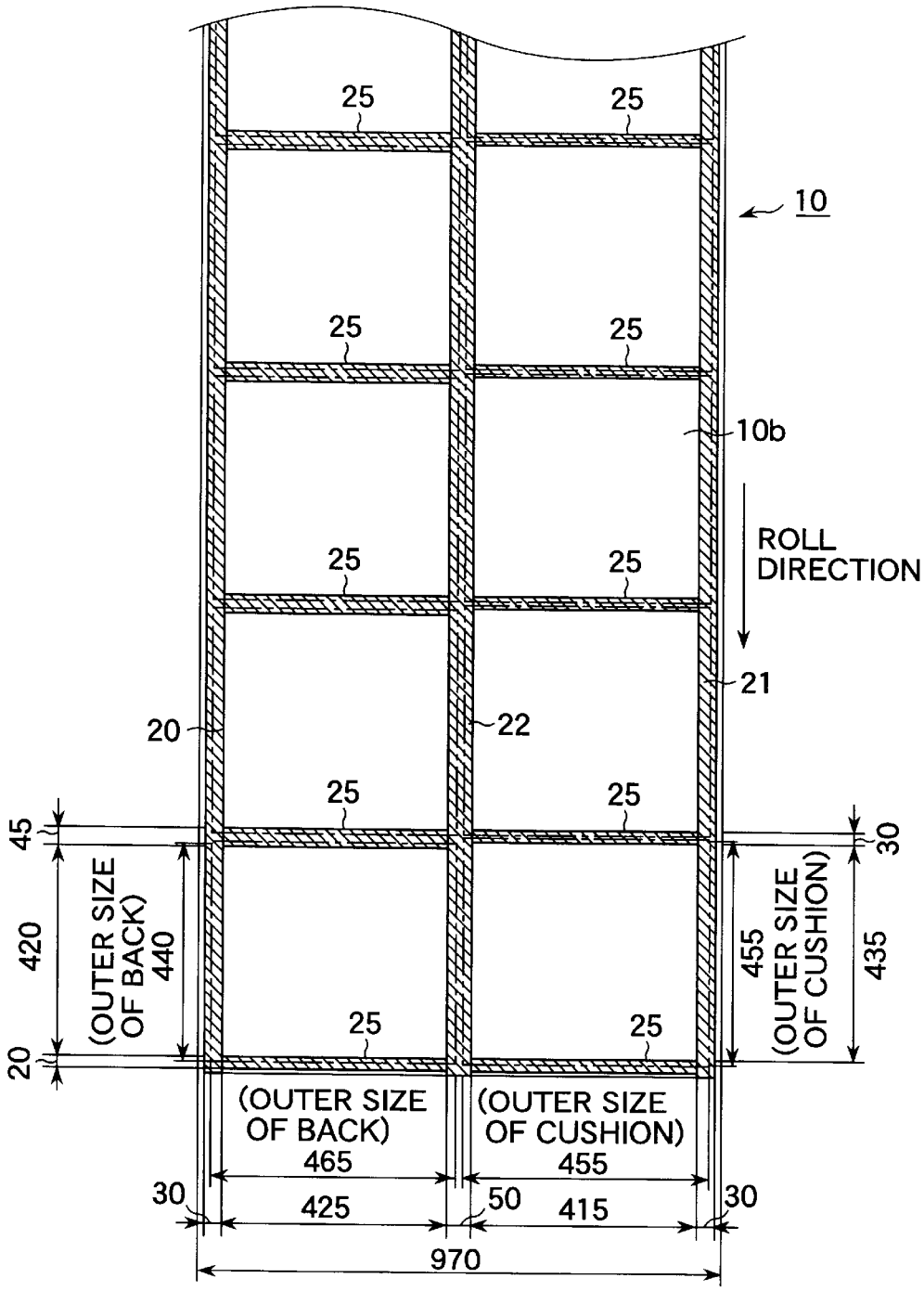
FIG. 9 is a plane view showing another embodiment of a net fabric to be processed into a net product according to the present invention; and Each of FIGS. 10(*a*) to 10(*e*) is a schematic view showing a type of a pile structure.
Figure 10A:
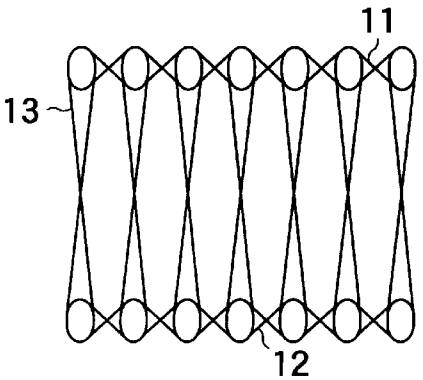
Figure 10B:
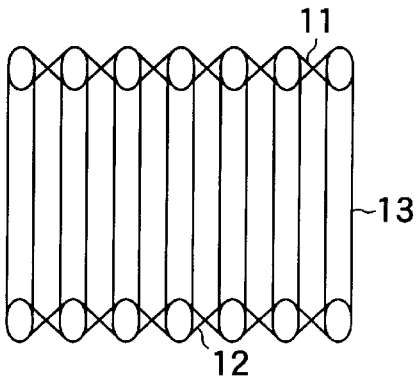
Figure 10C:
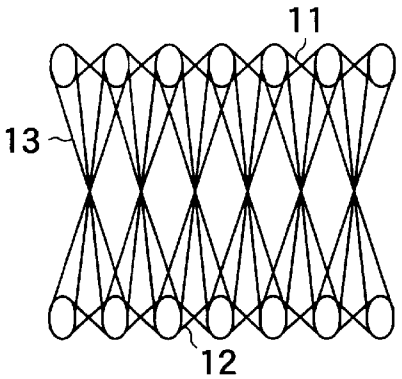
Figure 10D:
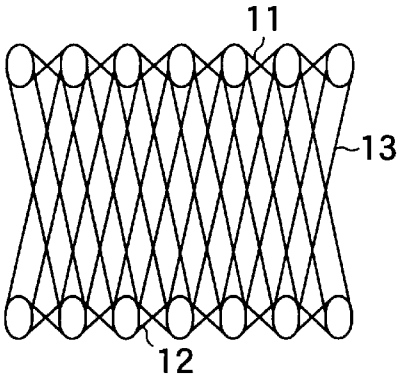
Figure 10E:
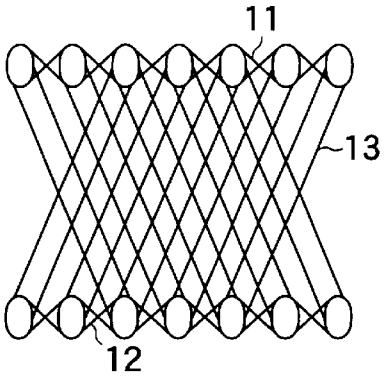

Referring now to FIG. 9, another embodiment of a net fabric to be processed into a net product according to the present invention is illustrated. A net fabric of the illustrated embodiment generally designated by reference numeral 10 in FIG. 9 includes second cut portions 25 along each of which respective sets of seat nets 10*c* (FIG. 5) having a back net 10*a* and a cushioning net 10*b* integrated together are cut from the net fabric 10. Each of the second cut portions 25 is formed into a predetermined width and has a higher compressibility in a thickness direction thereof than the intermediate portions 23 and 24 of the net fabric 10.

Such construction of the illustrated embodiment facilitates the operation of cutting the net fabric 10 along the predetermined cutting lines in the second cut portions 25 as in the operation of cutting it along the first cut portion 22. Also, the vibrational welding to end-treat each of the second cut portions 25 may be as workable as the vibrational welding to the first cut portion 22.

In the net fabric 10 for processing according to the present invention, it is merely required that the portions thereof to be subjected to processing such as cutting, vibrational welding or the like have a higher compressibility than the other portions thereof. Thus, the portions of the net fabric 10 which are to be processed are not limited to those in the embodiments described above. The portions of the net fabric to be processed are varied depending on a target net product desired. Thus, the portions that require a higher compressibility are determined based on the portions that need to be processed.

Even though the above description has been made in connection with processing for an automobile seat, the net fabric of the present invention may also be effectively applied to any other suitable seat such as a seat for a wheelchair, a seat for a chair for a learning desk, a seat for a chair for an office desk or the like.

As can be seen from the foregoing, the net fabric to be processed into a net product according to the present invention is so constructed that the portions thereof to be subjected to processing such as cutting, vibrational welding or the like have a relatively higher compressibility than the remaining portions thereof. Such construction ensures that the net fabric exhibits a better workability during the manufacturing of a net product using the net fabric in spite of the fabric's having a three-dimensional structure, to thereby simplify the manufacturing process, leading to a reduction in manufacturing cost of the net product.

While preferred embodiment of the invention have been described with a certain degree of particularity with reference to the drawings, obvious modifications and variations are possible in light of the above teachings. It is therefore to be understood that the scope of the invention is to be determined from the claims appended hereto.

What is claimed is:

1. A net fabric with a three-dimensional structure to be processed into a net product, comprising:

a front mesh layer having a first and second longitudinal edges;

a rear mesh layer having a first and second longitudinal edges that are coextensive with said first and second longitudinal edges of said front mesh layer;

a plurality of piles arranged between said front mesh layer and said rear mesh layer, said plurality of piles being coupled to said front mesh layer and to said rear mesh layer;

a portion of said front mesh layer adjacent said first longitudinal edge of said front mesh layer, a portion of said rear mesh layer adjacent said first longitudinal edge of said rear mesh layer and said piles arranged between said portions collectively defining a first longitudinal edge portion;

a portion of said front mesh layer adjacent said second longitudinal edge of said front mesh layer, a portion of said rear mesh layer adjacent said second longitudinal edge of said rear mesh layer and said piles arranged between said portions collectively defining a second longitudinal edge portion;

a portion of said front mesh layer arranged between said first and second longitudinal edges of said front mesh layer and a corresponding portion of said rear mesh layer between said first and second longitudinal edges of said rear mesh layer and said piles arranged between said portions collectively defining a center cut portion;

a portion of said front mesh layer between said first longitudinal edge portion and said center cut portion and a corresponding portion of said rear mesh layer between said first longitudinal edge portion and said center cut portion and said piles arranged between said portions collectively defining a first intermediate portion;

a portion of said front mesh layer between said second longitudinal edge portion and said center cut portion and a corresponding portion of said rear mesh layer between said second longitudinal edge portion and said center cut portion and said piles arranged between said portions collectively defining a second intermediate portion;

wherein each of said first longitudinal edge portion, said second longitudinal edge portion and said center cut portion have a compressibility in a thickness direction that is higher than a compressibility of said first intermediate portion and said second intermediate portion in a thickness direction.

2. A net fabric as defined in claim 1, wherein a difference between the compressibility of said first longitudinal edge portion, said second longitudinal edge portion and said center cut portion and the compressibility of said first intermediate portion and said second intermediate portion is at least 5%.

3. A net fabric as defined in claim 2, wherein the difference in compressibility between said first longitudinal edge portion, said second longitudinal edge portion and said center cut portion and said first intermediate portion and said second intermediate portion is within a range from about 10% to about 70%.

4. A net fabric as defined in claim 1, wherein said compressibility of said first longitudinal edge portion, said second longitudinal edge portion and said center cut portion is adjusted by adjusting a density of the plurality of piles in said first longitudinal edge portion, said second longitudinal edge portion and said center cut portion.

5. A net fabric as defined in claim 1, wherein said compressibility of said first longitudinal edge portion, said second longitudinal edge portion and said center cut portion is adjusted by adjusting any one element selected from the group consisting of a mesh configuration of the front mesh layer, a mesh size of the front mesh layer, a mesh configuration of the rear mesh layer, a mesh size of the rear mesh layer, the density of said plurality of piles, a length of the piles between the front mesh layer and the rear mesh layer, a thickness of the piles, and any combination of these elements.

6. A net fabric as defined in claim 1, wherein said compressibility is adjusted by varying a material of fibers being used in at least one of the front mesh layer, said rear mesh layer and said plurality of piles.

7. A net fabric as defined in claim 6, wherein the material of fibers being used in at least one of said front mesh layer, said rear mesh layer and said plurality of piles is selected from the group consisting of polyester, polypropylene, or polybutylene terephthalate.

8. A net fabric as defined in claim 1, wherein said compressibility is adjusted by varying a fiber structure of a fiber being used in at least one of the front mesh layer, said rear mesh layer and said plurality of piles.

9. A net fabric as defined in claim 8, wherein the fiber structure of the fiber being used in at least one of the front mesh layer, said rear mesh layer and said plurality of piles is selected from the group consisting of monofilament, multifilament, or spun yarn.

10. A net fabric as defined in claim 1, wherein first longitudinal edge portion, said second longitudinal edge portion, said center cut portion and said first and second intermediate portions are initially manufactured as a single piece and then said single piece is cut along said center cut portion to form a back portion and a cushioning portion of an automobile seat.

* * * * *